US005297887A

United States Patent [19]

Williams

[11] Patent Number: 5,297,887

[45] Date of Patent: Mar. 29, 1994

[54] INJECTION-MOLDED RECEIVER

[76] Inventor: Stephen R. Williams, 530 Turkey Trail, Shreveport, La. 71115

[21] Appl. No.: 934,104

[22] Filed: Aug. 21, 1992

[51] Int. Cl.[5] ..... B25G 3/00; A47K 5/02; A47L 13/24

[52] U.S. Cl. ..... 403/299; 403/306; 15/145; 15/176.2

[58] Field of Search ..... 403/299, 306, 300; 15/145, 143.1, 176.2

[56] References Cited

U.S. PATENT DOCUMENTS

| | | | |
|---|---|---|---|
| 1,020,018 | 3/1912 | Bonin | 15/176.2 |
| 1,632,227 | 6/1927 | Halsey | 16/121 |
| 1,664,257 | 3/1928 | McCullough | 16/111 R |
| 2,444,758 | 7/1948 | Stillbach | 15/145 |
| 2,705,336 | 4/1955 | Wilson | 15/145 |
| 3,371,367 | 5/1968 | Tigerman | 15/145 |
| 4,530,130 | 7/1985 | Moss | 15/145 |
| 4,928,342 | 5/1990 | Friedman | 15/145 |

FOREIGN PATENT DOCUMENTS

| | | | |
|---|---|---|---|
| 3001495 | 7/1981 | Fed. Rep. of Germany | 15/145 |

*Primary Examiner*—Paula A. Bradley
*Assistant Examiner*—Rex E. Pelto
*Attorney, Agent, or Firm*—John M. Harrison

[57] ABSTRACT

An injection-molded receiver for securing a mop handle, broom handle or alternative cleaning or utility handle to a mop, broom or other cleaning or utility implement or tool having a threaded mounting stud. The injection-molded receiver includes a receiver cap having a cap opening for receiving and mounting one end of the handle and a cap base integrally formed in the receiver cap and fitted with an internally-threaded insert having flange cleats which is injection-molded into the cap base for threadably receiving the threaded mounting stud attached to the cleaning or utility implement, for example, a screw-type mop head. Injection-molding of the insert in the cap base of the receiver facilitates stability, longevity and ease of coupling a screw-type mop or similar utility implement or tool to a handle.

13 Claims, 1 Drawing Sheet

INJECTION-MOLDED RECEIVER

BACKGROUND OF THE INVENTION

1. Field of the Invention

This invention relates to cleaning or utility implements and tools and more particularly, to a new and improved injection-molded receiver for coupling a screw-type mop, broom or other utility or cleaning implement or tool to a shaft or handle. In a preferred embodiment, the injection-molded receiver is characterized by a cylindrical receiver cap fitted with a cap opening for receiving and mounting one end of the shaft or handle and further including a cap base which is integrally formed with the receiver cap and includes an internally-threaded metal insert injection-molded therein for threadably receiving the stud of a screw-type mop, broom or other utility or cleaning implement or tool. The shaft or handle is typically glued in the cap opening of the receiver cap, thereby permitting threadable application and removal of a mop, broom or other implement or tool to and from the receiver cap and attached handle, as deemed necessary.

One of the problems which is realized in attaching brooms, mops and other utility or cleaning implements or tools, and mops in particularly, to one end of a shaft or handle, is that of bending or breaking the connecting member which attaches the mop, broom or other implement or tool to the handle, due to pressure applied to the handle during use. This problem is particularly manifested in the use of mops, because considerable pressure must be applied to the mop and mop handle in order to accomplish the desired cleaning.

2. Description of the Prior Art

A typical technique for attaching a screw-type mop head and mop to one end of an elongated shaft or handle is by means of a metal ferrule which is secured by a rivet through the handle, thereby trapping a threaded receiver or nipple permanently in place. Repetitive pressure applied to the mop handle during the cleaning operation frequently loosens or bends this rivet and ferrule on the end of the handle, thereby ultimately loosening the handle-mop connection and rendering the handle useless for its intended purpose. An adaptation of the metal ferrule connection is the nylon ferrule which is attached to a fiberglass shaft or handle, thereby trapping the metal receiver or nipple in position to receive the screw-type mop or other cleaning or utility implement. However, pressure applied to the handle and mop during normal mopping operation ultimately may also cause the nylon ferrules to break after multiple flexures.

Various other types of connections between handles and rods or shafts are well known in the art. Typical of these is the device detailed in U.S. Pat. No. 1,632,227 dated Jun. 14, 1927, to C. W. Halsey, entitled "Resilient Grip for Implement Handles". The handle of an implement such as an ice pick is fitted with a detachable grip which is formed of rubber or other resilient material to cushion the effects in chipping ice and minimize the danger of injuries to the operator. A "Golf Club Grip Guide" is detailed in U.S. Pat. No. 1,664,257, dated Mar. 27, 1928, to C. McCullough. The golf grip guide is fabricated in the shape of a resilient sleeve having the impression of hands and fingers formed in the peripheral surface, such that the player must grip or hold the golf club in the correct or approved manner. The golf club guide is resilient and is designed to be distended circumferentially and sprung over the slightly tapered handle portion of the golf club to remain in position on the handle. A "Cleaning Instrument Having A Detachable Handle Provided With A Cap" is detailed in U.S. Pat. No. 2,705,336, dated Apr. 5, 1955. The handle is fitted with a cap at one end and threads at the opposite end for threadable insertion into corresponding internal threads provided in a block which mounts a brush. A "Handle For Paint Roller" is detailed in U.S. Pat. No. 3,371,367, dated Mar. 5, 1968, to L. Tigerman. The primary handle mounts a wire paint roller mechanism and the butt of the handle includes an internally-threaded metal socket which is secured therein to receive an extension. The metal socket is spot-welded inside the handle to maintain structural integrity for receiving and mounting the extension.

It is an object of this invention to provide an injection-molded receiver for attaching a handle or shaft to a screw-type mop, broom or other utility or cleaning implement or tool in a secure, easily installed, esthetically-pleasing manner.

Another object of this invention is to provide an injection-molded connecting receiver which is characterized by a receiver cap having a cap opening for receiving and mounting one end of a shaft or handle, a cap base integrally formed with the receiver cap and fitted with an internally-threaded insert which is injection-molded in the cap base for threadably receiving the threaded stud or receiver of a screw-type mop, broom or other implement or tool and mounting the mop, broom or other implement or tool securely to the shaft or handle.

Still another object of this invention is to provide an injection-molded plastic receiver for securing a shaft or handle to a tool or implement, which receiver includes a cylindrical receiver cap having a cap opening for receiving and securely mounting one end of the shaft or handle and a cap base shaped in one end of the receiver cap and having an insert injection-molded therein, which insert is fitted with internal threads that threadably receive the projecting studs from screw-type mops, brooms or other implements or tools to securely, yet removably, mount the mops, brooms or other implements or tools to the injection-molded receiver and hence, the shaft or handle.

SUMMARY OF THE INVENTION

These and other objects of the invention are provided in a new and improved, injection-molded plastic receiver characterized by a cylindrical receiver cap having a cap opening for receiving and gluing a shaft or handle and a solid plastic cap base integrally molded with the receiver cap and provided with a metal insert injection-molded therein, which insert includes a barrel having internal threads and a flange with flange cleats extending from the barrel and embedded in the cap base for securing the insert in the cap base, receiving the stud or receiver of a screw-type mop and securely, yet removably, mounting the screw-type mop to the shaft or handle.

BRIEF DESCRIPTION OF THE DRAWING

This invention will be better understood by reference to the accompanying drawing wherein.

DESCRIPTION OF THE PREFERRED EMBODIMENTS

Figure 1:
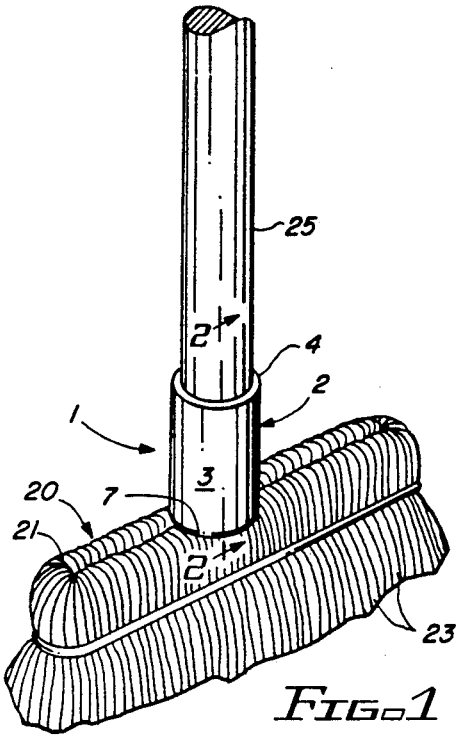
FIG. 1 is a perspective view of the injection-molded receiver of this invention securing a mop handle to a mop.
Figure 2:
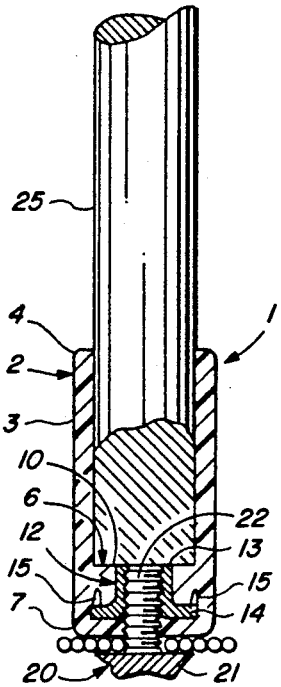
FIG. 2 is a sectional view taken along line 2—2 of the mop handle, injection-molded receiver and mop illustrated in FIG. 1.
Figure 4:
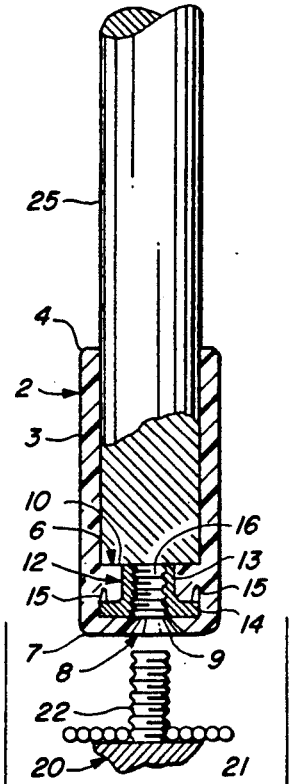
FIG. 4 is a sectional view taken along line 4—4 of the mop handle, injection-molded receiver and mop illustrated in FIG. 3.
Figure 3:
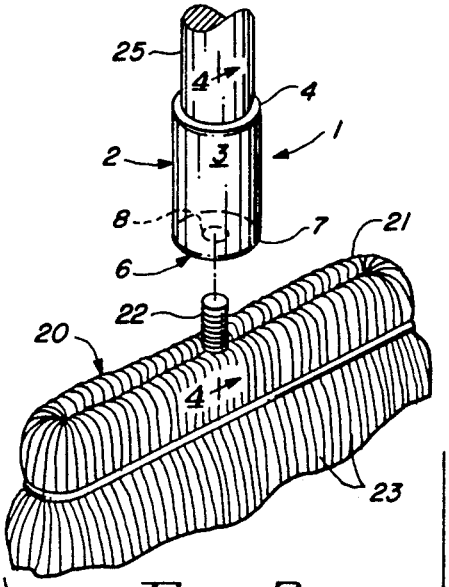
FIG. 3 is an exploded view of the injection-molded receiver, mop handle and mop illustrated in FIG. 1.
Figure 5:
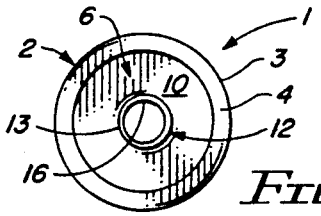
FIG. 5 is top view of the injection-molded receiver illustrated in FIGS. 1-4.

Referring initially to FIGS. 1-6 of the drawing, a preferred embodiment of the injection-molded receiver of this invention is generally illustrated by reference numeral 1. The injection-molded receiver 1 is characterized in a most preferred embodiment by a cylindrical receiver cap 2, which receiver cap 2 is shaped of an injection-moldable plastic material such as polyethylene, polypropylene, nylon, or like material. The receiver cap 2 includes a cap wall 3 of selected thickness, which defines a cap opening 5 at one end that terminates at a flat base shoulder 10. A curved wall margin 4 is provided at the periphery of the cap wall 3, as further illustrated in FIGS. 2 and 4. A cap base 6 is integrally molded into the receiver cap 2 adjacent to the bottom of the cap opening 5 at the opposite end of the injection-molded receiver 1 and terminates at a curved base margin 7 and includes a base receptacle 8, having a base receptacle taper 9. A metal insert 12 is injection-molded in the cap base 6 of the receiver cap 2 between the base shoulder 10 and the base receptacle 8. The insert 12 includes a cylindrical insert barrel 13, aligned with the base receptacle 8 and provided with a flat barrel flange 14 at one end and multiple flange cleats 15, punched from the barrel flange 14 for embedment in the cap base 6 to further stabilize the insert 12 in the cap base 6. Barrel threads 16 are internally provided in the insert barrel 13 for threadably receiving a mop head stud 22, extending from the mop head 21 of a screw-type mop 20, as illustrated in FIGS. 2-4.

Accordingly, referring again to FIGS. 1 and 2 of the drawing, it will be appreciated that the screw type mop 20 can be securely, yet removably, mounted on the receiver cap 2 by extending the mop head stud 22 through the base receptacle 3 in the cap base 8 and subsequently threading the mop head stud 22 into the barrel threads 16 of the insert 12, which is injection-molded in the cap base 6 of the receiver cap 2. Furthermore, one end of a handle 25 may be secured to the receiver cap 2 of the injection-molded receiver 1 by inserting it in the cap opening 5 with application of a suitable glue to permanently secure the handle 25 in the receiver cap 2, as illustrated.

Figure 6:
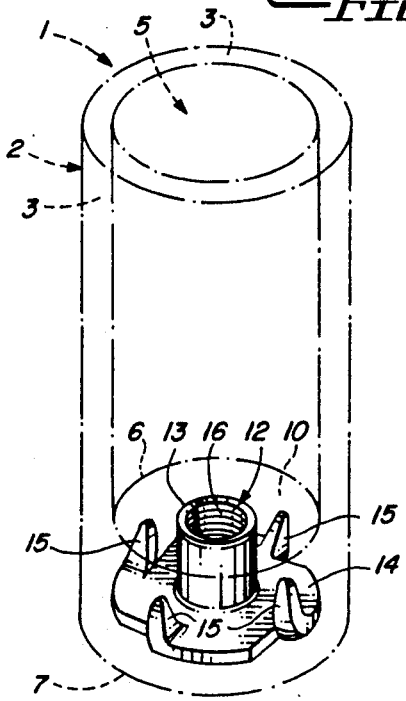
FIG. 6 is a perspective view of the injection-molded receiver illustrated in FIGS. 1-5, with the receiver cap and cap base components illustrated in phantom and the insert functionally injection-molded in the cap base.

It will be appreciated from a consideration of FIG. 6 that the spaced flange cleats 15, extending from the flat barrel flange 14 of the insert barrel 13 in the insert 12, serve to stabilize the insert 12 in injection-molded configuration inside the cap base 6 and prevent undesirable rotation or movement of any description of the insert 12 in the cap base 6. Furthermore, the cap wall 3 of the receiver cap 2 is sufficiently thick to retain good structural integrity in the injection-molded receiver 1, such that pressure applied to the handle 25 when the screw-type mop 20 is attached to the injection-molded receiver 1, will not crack or splinter the cap wall 3. Since the metal insert 12 is secured internally in the cap base 6 of the receiver cap 2, the mop head stud 22 can be quickly and easily extended through the base opening 8 in the cap base 6 and threadably inserted in the barrel threads 16 of the insert barrel 13 without fear of loosening or dislodging the insert 12. Furthermore, considerable pressure can be applied to the mop head 21 to unthread the mop head stud 22 from the barrel threads 16 without splitting or breaking the receiver cap 2. Accordingly, when the yarn 23 in the screw-type mop 20 becomes frazzled or worn to the point where the screw-type mop 20 is no longer serviceable, the mop head 21 can be grasped or stabilized with the foot and the handle 25 twisted to cause the mop head stud 22 to quickly and easily unthread from the barrel threads 16 of the insert barrel 13 and a new screw-type mop 20 attached to the injection-molded receiver 1 in like manner.

It will be further appreciated by those skilled in the art that the injection-molded receiver 1 of this invention may be utilized with handles 25 constructed of various materials, including wood, fiberglass, plastic and the like, according to the needs of the user. Furthermore, while the screw-type mop 20 is a primary cleaning implement used for connection to the injection-molded receiver 1, it is understood that other screw-type instruments, implements and tools such as brooms, sponge mops, paint rollers and the like, requiring a handle for use, may also be connected to a handle using the injection-molded receiver 1, as desired. Moreover, although a preferred technique for securing the handle 25 in the receiver cap 2 is by application of a suitable glue, the handle 25 may also be thusly mounted by means of one or more pins or rivets, both with or without application of glue. Typical applications include the use of both aluminum and nylon pins or rivets, in non-exclusive particular.

The injection-molded receiver 1 is injection-molded using a suitable mold which mounts the insert 12 in position to receive liquid plastic material such as polyethylene, polypropylene, nylon or the like, in non-exclusive particular, and then facilitates removal of the receiver cap 2 with the insert 12 secured in the center of the cap base 6, according to the knowledge of those skilled in the art. When the injection-molded receiver 1 is cooled, the plastic material shrinks tightly around the insert 12, thereby tightly and securely mounting the insert 12 inside the cap base 6.

It will be further appreciated by those skilled in the art that the injection-molded receiver 1 of this invention facilitates floating head efficiency in the mop head 21, since the mop head stud 22 can be partially unthreaded from the insert 12 and receiver cap 2. This allows the mop head 21 to be "free floating", as opposed to the rigid, heavy handle conventional systems. This expedient can be effected without concern for bending or breaking the conventional ferrules which attach typical screw-type mops to handles in conventional manner. Furthermore, the screw-type mop 20 or other cleaning implement or tool can be quickly and easily removed from the handle 25 by simply placing a foot on the yarn 23, mop head 21 or other implement or tool and rotating the handle to unthread the mop head stud 22 from the insert 12. This procedure can be undertaken with confidence that considerable torque applied to the handle 25 will not break or damage the injection-molded receiver 1.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A handle-to-implement injection-molded receiver/connector comprising a receiver cap having a cap opening for receiving the handle and an insert barrel, barrel threads provided in said insert barrel, a barrel flange terminating one end of said insert barrel and flange cleats projecting from said barrel flange in spaced relationship with respect to said insert barrel, with said insert barrel, said barrel flange and said flange cleats embedded in said receiver cap for threadably receiving the implement.

2. The handle-to-implement injection-molded receiver/connector of claim 1 wherein said receiver cap is cylindrical.

3. The handle-to-implement injection-molded receiver/connector of claim 1 wherein said receiver cap further comprises a cap base terminating said cap opening and wherein said insert barrel, said barrel flange and said flange cleats are molded into said cap base.

4. The handle-to-implement injection-molded receiver/connector of claim 3 wherein said receiver cap is cylindrical.

5. The handle-to-implement injection-molded receiver/connector of claim 3 further comprising a base opening provided in said cap base, said base opening communicating with said barrel.

6. The handle-to-implement injection-molded receiver/connector of claim 5 wherein said base opening is tapered from a wide mouth at the end of said cap base to a narrow opening at said barrel.

7. The handle-to-implement injection-molded receiver/connector of claim 6 wherein said receiver cap and said opening are cylindrical.

8. A handle-to-implement injection-molded receiver/connector for attaching a handle to a threaded implement, comprising a receiver cap having a cap opening for receiving one end of the handle, a base portion provided in said receiver cap adjacent to said cap opening and an insert barrel, barrel threads provided in said insert barrel for engaging the threaded implement, a barrel flange terminating one end of said insert barrel and flange cleats projecting from said barrel flange in spaced relationship with respect to said insert barrel, with said insert barrel, said barrel flange and said flange cleats embedded in said base portion of said receiver cap for receiving the threaded implement in threadable relationship.

9. The injection-molded receiver of claim 8 wherein said insert means further comprises an insert barrel, barrel threads provided in said insert barrel for engaging the threaded implement and a barrel flange extending from said insert barrel, with said insert barrel and said barrel flange embedded in said base portion of said receiver cap.

10. The handle-to-implement injection-molded receiver/connector of claim 8 wherein said receiver cap is cylindrical.

11. The handle-to-implement injection-molded receiver/connector of claim 10 further comprising a base opening provided in said base portion of said receiver cap, said base opening communicating with said insert barrel.

12. A handle-to-implement injection-molded receiver/connector for threadably mounting a screw-type mop having a threaded stud on a handle, comprising a receiver cap having a cap opening for receiving and mounting the handle in fixed relationship, a base portion integrally molded with said receiver cap, a base opening provided in said base portion and an insert barrel, barrel threads provided in said insert barrel for engaging the threaded stud and a barrel flange terminating one end of said insert barrel, with said insert barrel and said barrel flange embedded in said base portion of said receiver cap and further comprising flange cleats projecting from said barrel flange in spaced relationship and embedded in said base portion for threadably receiving the threaded stud as extended through said base opening and removably attaching the screw-type mop to said injection-molded receiver.

13. The handle-to-implement injection-molded receiver/connector of claim 12 wherein said receiver cap and said cap opening are cylindrical.

* * * * *